US009441924B1

(12) United States Patent
Frericks

(10) Patent No.: US 9,441,924 B1
(45) Date of Patent: Sep. 13, 2016

(54) USER CONFIGURABLE SHAPE CHARGE LINER AND HOUSING

(71) Applicant: Lonnie Frericks, King George, VA (US)

(72) Inventor: Lonnie Frericks, King George, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/121,427

(22) Filed: Sep. 5, 2014

(51) Int. Cl.
*F42B 1/02* (2006.01)
*F42B 1/028* (2006.01)
*F42B 1/032* (2006.01)

(52) U.S. Cl.
CPC ..... *F42B 1/028* (2013.01); *F42B 1/032* (2013.01)

(58) Field of Classification Search
CPC ..... F42B 1/028; F42B 1/02; F42B 12/10; F42B 12/22
USPC ..... 102/306, 307
See application file for complete search history.

(56) References Cited

U.S. PATENT DOCUMENTS 2,870,709 A * 1/1959 Boelter, Jr. ..... F42B 1/032 102/306
3,431,850 A * 3/1969 Christopher ..... F42B 1/036 102/306
3,995,549 A * 12/1976 Mullen, Jr. ..... F42B 12/22 102/476
4,187,782 A * 2/1980 Grace ..... F42B 1/02 102/475
4,641,581 A * 2/1987 Weickert ..... F42B 3/224 102/307
4,942,819 A * 7/1990 Thoma ..... F42B 1/024 102/307
5,648,635 A * 7/1997 Lussier ..... E21B 43/117 102/307
6,840,178 B2 1/2005 Collins et al.
7,536,956 B2 5/2009 Sammons et al.
8,272,330 B1 9/2012 Gold et al.
8,734,960 B1 * 5/2014 Walker ..... F42B 1/028 102/306
9,188,413 B2 * 11/2015 McLean ..... F42B 1/028
2003/0131749 A1 * 7/2003 Lussier ..... F42B 1/028 102/306
2013/0224061 A1 8/2013 Walker
2014/0060369 A1 * 3/2014 Mclean ..... F42B 12/10 102/310

* cited by examiner

*Primary Examiner* — Samir Abdosh
(74) *Attorney, Agent, or Firm* — Frederic J. Zimmerman

(57) ABSTRACT

A configurable shape charge liner includes a cone. The cone is hollow and includes a cone bottom portion, which has a cone bottom diameter. The configurable shape charge liner includes at least one circular ring section. Each of at least one circular ring section is hollow and includes a circular ring section top diameter and a circular ring section bottom diameter. The circular ring section top diameter is less than the circular ring section bottom diameter. The cone and at least one circular ring section are connectable therebetween to form different overall diameters for the configurable shape charge liner. The configurable shape charge liner includes a conical shape.

17 Claims, 9 Drawing Sheets

USER CONFIGURABLE SHAPE CHARGE LINER AND HOUSING

STATEMENT OF GOVERNMENT INTEREST

The present invention described herein may be manufactured and used by or for the Government of the United States of America for government purposes without the payment of any royalties thereon or therefore.

FIELD OF THE DISCLOSURE

The present disclosure relates generally to shaped charges. More particularly, the present disclosure relates to a user configurable shape charge liner and housing.

BACKGROUND OF THE DISCLOSURE

A shaped charge is an explosive charge shaped to focus the effect of the explosive's energy. Various types are used to cut and form metal, initiate nuclear weapons, penetrate armor, complete wells in the oil and gas industry, Explosive Ordnance Disposal (EOD), and the like. A typical device includes a solid cylinder of explosive with a metal-lined conical hollow in one end and a central detonator, array of detonators, or detonation wave guide at the other end. Explosive energy is released directly away from (normal to) the surface of an explosive, so shaping the explosive will concentrate the explosive energy in the void. If the hollow is properly shaped (usually conically), the enormous pressure generated by the detonation of the explosive drives the liner in the hollow cavity inward to collapse upon its central axis. The resulting collision forms and projects a high-velocity jet of metal particles forward along the axis. Most of the jet material originates from the innermost part of the liner, a layer of about 10% to 20% of the thickness. The rest of the liner forms a slower-moving slug of material, which, because of its appearance, is sometimes called a "carrot". Because of the variation along the liner in its collapse velocity, the jet's velocity also varies along its length, decreasing from the front. This variation in jet velocity stretches it and eventually leads to its break-up into particles. Over time, the particles tend to fall out of alignment, which reduces the depth of penetration at long standoffs.

Shaped charges can be varied based on their diameter (which determines penetration) and angle of the liner (which determines the jet speed). In general, shaped charges may penetrate a steel plate as thick as 150% to 700% of their diameter, depending on the charge quality. The most common shape of the liner is conical, with an internal apex angle of 40 to 90 degrees. Different apex angles yield different distributions of jet mass and velocity. Small apex angles may result in jet bifurcation, or even in the failure of the jet to form at all; this is attributed to the collapse velocity being above a certain threshold, normally slightly higher than the liner material's bulk sound speed. Other widely used shapes include hemispheres, tulips, trumpets, ellipses, and bi-conics; the various shapes yield jets with different velocity and mass distributions.

Conventional shaped charge liners, e.g. cones, are fixed shape (diameter) and size (angle) and manufactured as a fixed item with a same metallic material. One problem is these are bulky and hard to carry. Another problem is they do not allow modification in the field in terms of size or metals. Also, shape housings are also bulky (tubes) and difficult to carry. It would be advantageous to have a user configurable shape charge liner and housing that is configurable in the field, easy to transport, and deployable with different materials as needed.

BRIEF SUMMARY OF THE DISCLOSURE

In an exemplary embodiment, a configurable shape charge liner includes a cone, wherein the cone is hollow and comprising a cone bottom portion comprising a cone bottom diameter; and one or more circular ring sections. Each of the one or more circular rings sections are hollow and comprise a circular ring section top diameter and a circular ring section bottom diameter. The circular ring section top diameter is less than (smaller) than the circular ring section bottom diameter. The cone and one or more circular ring sections are connectable therebetween to form different overall diameters for the configurable shape charge liner. The configurable shape charge liner includes a conical shape.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, the present disclosure relates generally to a User Configurable Shape Charge Liner (UCSCL) and Housing. This disclosure addresses the aforementioned limitations by being modular, easily packable, and configurable in the field. The User Configurable Shape Charge Liner (UCSCL) is a modular liner that may be built with the same common components into a 1", 2", 3", and 4" inch (for example) diameter shape charge. Its components may be made of several different materials such as copper, magnesium, zirconium, glass, metal alloys or other suitable materials, which may be mixed and matched within the same shape charge cone to provide tailored effects.

Figure 1:
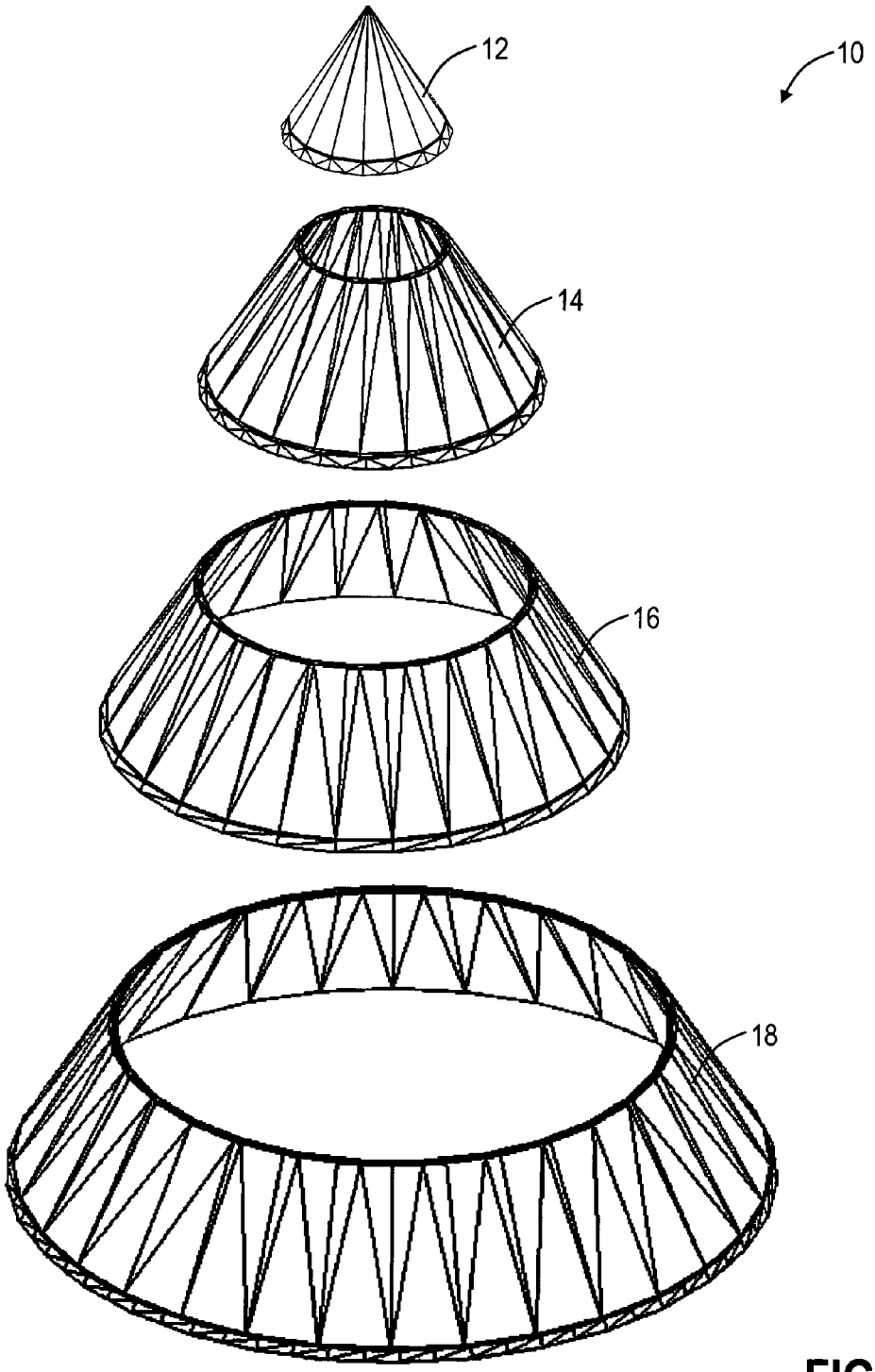
FIG. 1 is a perspective diagram of a User Configurable Shape Charge Liner (UCSCL) in accordance with an exemplary embodiment.

Referring to FIG. 1, in an exemplary embodiment, a perspective diagram illustrates a User Configurable Shape Charge Liner (UCSCL) 10. The UCSCL 10 includes various sections including a cone 12, a first circular ring 14, a second circular ring 16, and a third circular ring 18. The cone 12 and the circular rings 14, 16, 18 are configured to connect to one another and form a larger cone that is a shape charge liner. Note, while the UCSCL 10 is described herein with four exemplary parts, this is for illustration purposes, and those of ordinary skill in the art will recognize more or less parts may be used to make the shape charge liner.

The UCSCL 10 allows a user in the field, for example, a dismounted warfighter, the ability to tailor shape charge diameter and effects. The modular liner approach allows each shape charge jet to contain several mixed effects between copper, magnesium, zirconium and glass/metal alloys, i.e. copper for penetration followed by magnesium or zirconium for thermal effects. That is, each of the cone 12 and the circular rings 14, 16, 18 may be any of copper, magnesium, zirconium and glass/metal alloys in a configurable manner as desired for different effects. A key aspect of the UCSCL 10 is that the shaped charge liner is not manufactured as a single piece, but connectable sections, which may be different materials.

Figure 2:
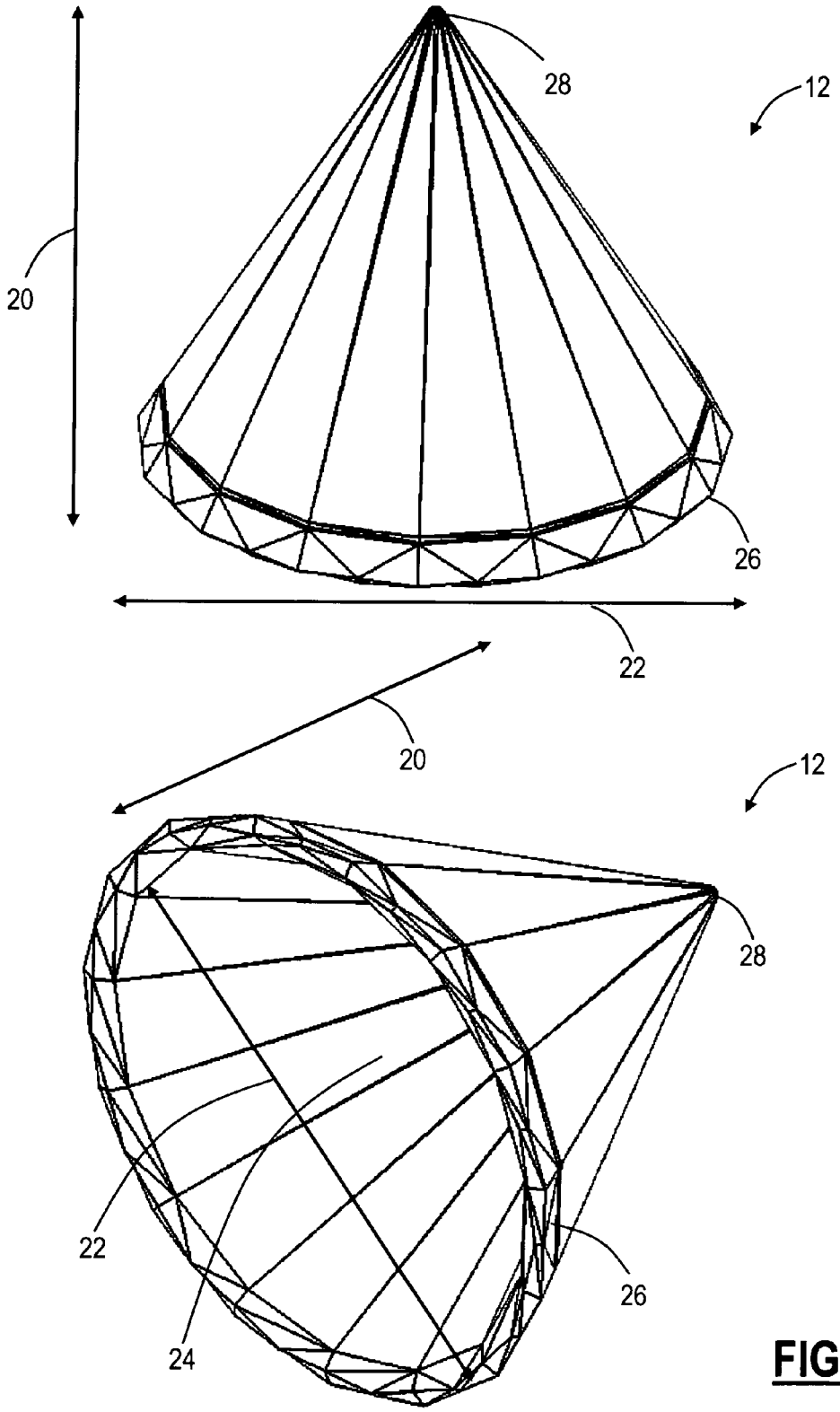
FIG. 2 is perspective diagrams of a cone portion of the UCSCL from FIG. 1 in accordance with an exemplary embodiment.
Figure 3:
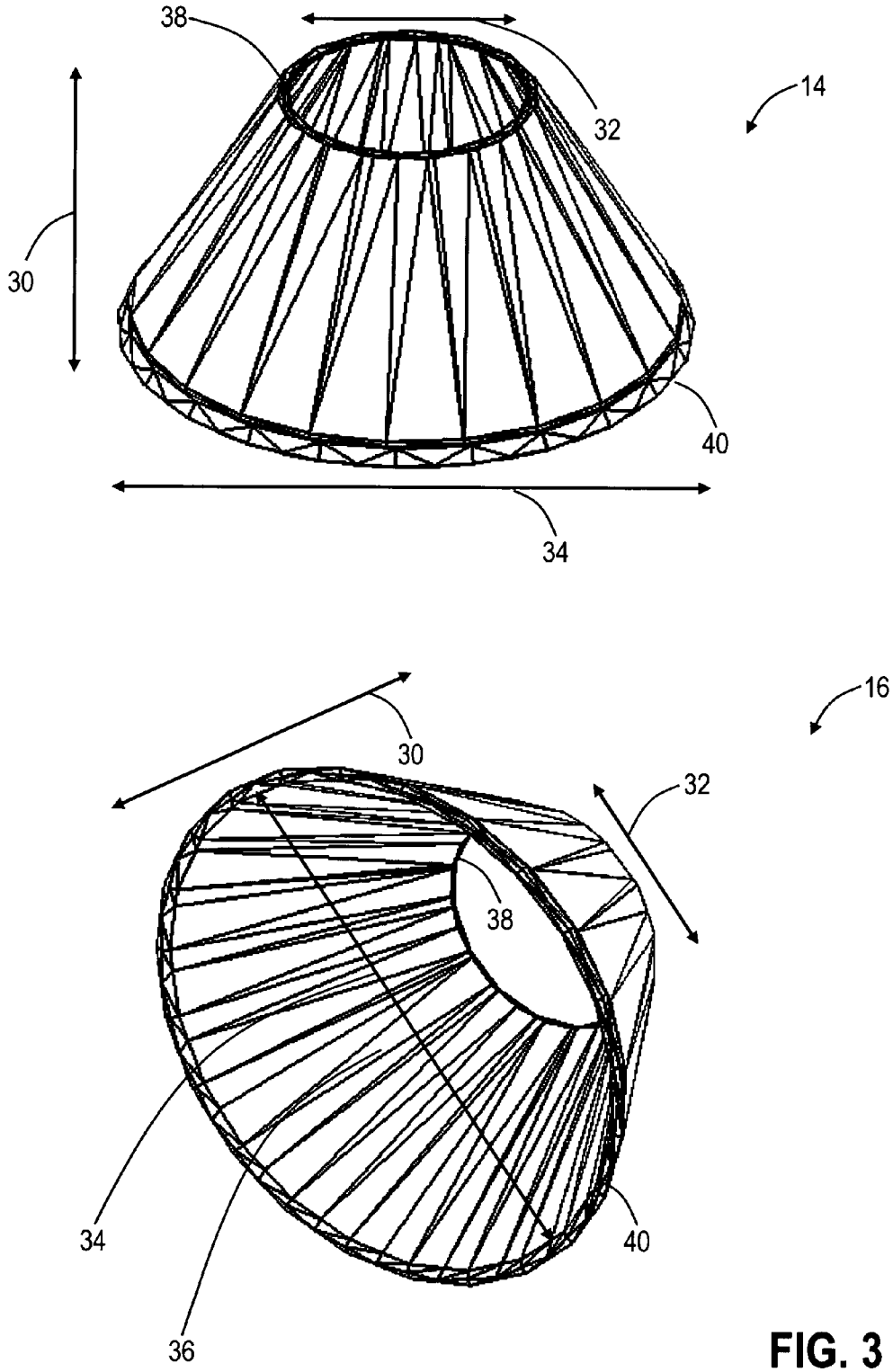
FIG. 3 is perspective diagrams of a first circular ring portion of the UCSCL from FIG. 1 in accordance with an exemplary embodiment.
Figure 4:
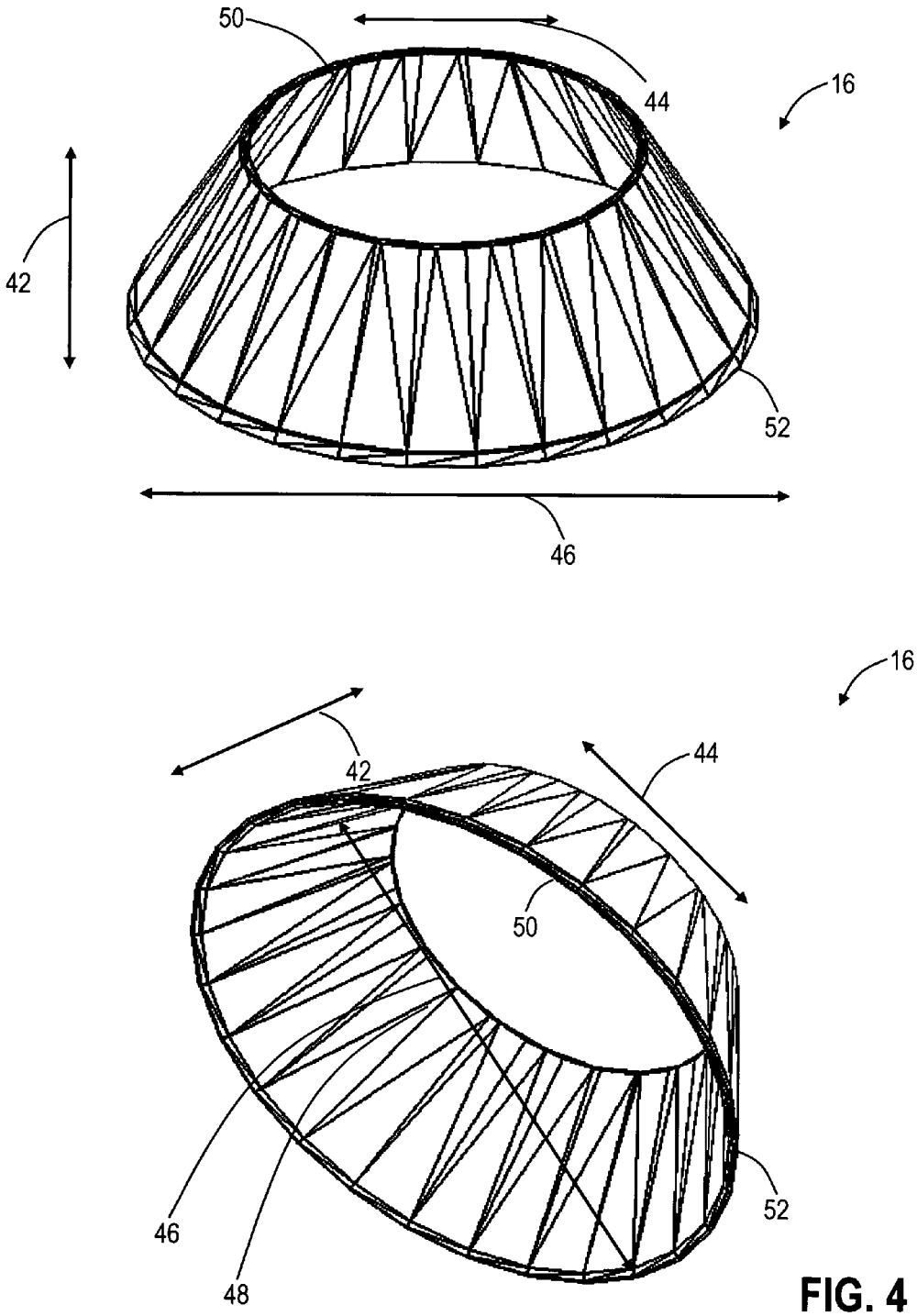
FIG. 4 is perspective diagrams of a second circular ring portion of the UCSCL from FIG. 1 in accordance with an exemplary embodiment.
Figure 5:
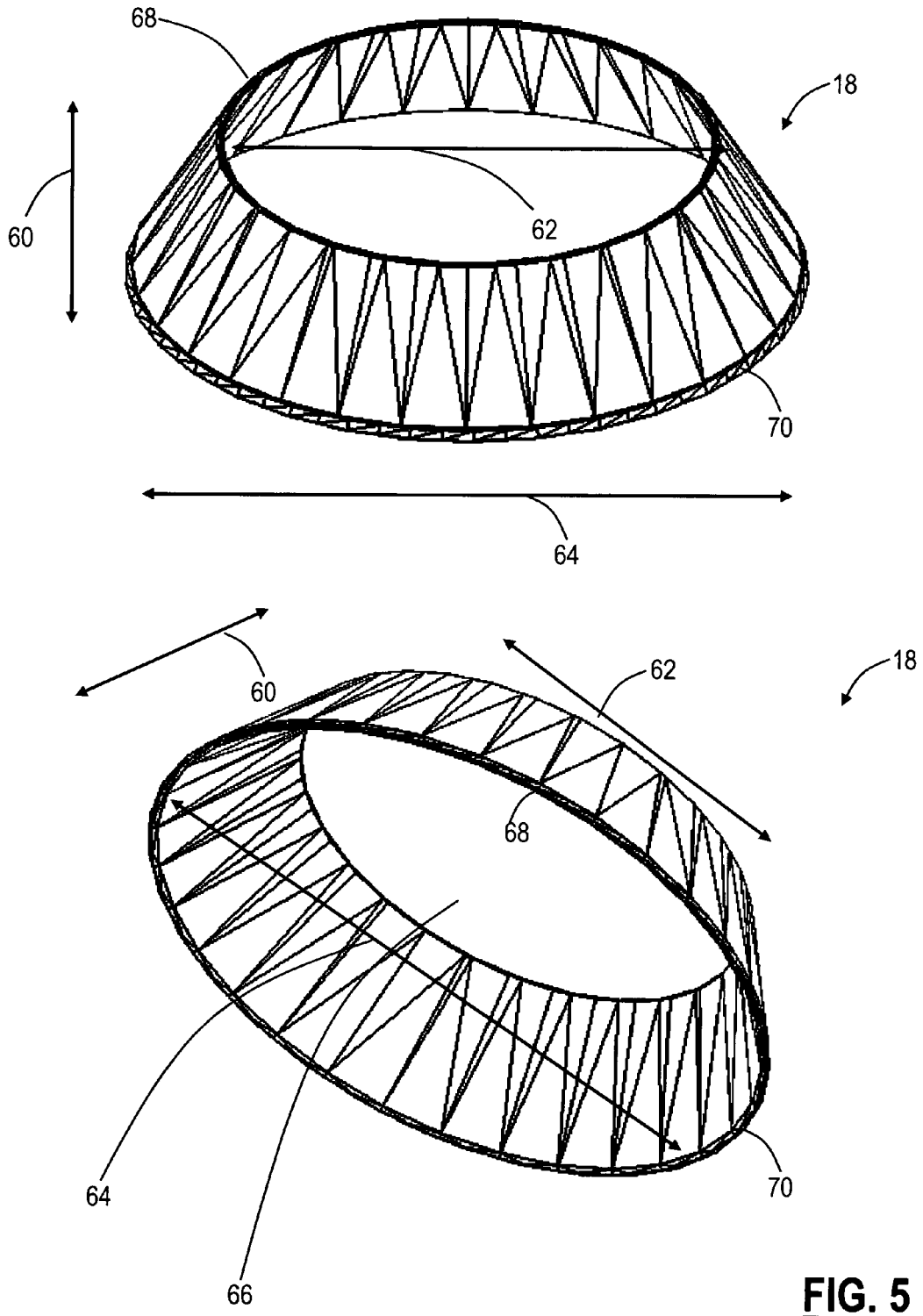
FIG. 5 is perspective diagrams of a third circular ring portion of the UCSCL from FIG. 1 in accordance with an exemplary embodiment.

Referring to FIGS. 2-5, in exemplary embodiments, perspective diagrams illustrate various views of the cone 12 (FIG. 2), the first circular ring 14 (FIG. 3), the second circular ring 16 (FIG. 4), and the third circular ring 18 (FIG. 5). In FIG. 2, the cone 12 includes a height 20 and a diameter 22. Also, the cone 12 includes a hollow portion 24. The cone 12 forms the top of the UCSCL 10. In an exemplary embodiment, the diameter 22 is about 1" although other values are contemplated. The cone 12 includes a bottom portion 26 and a point 28 at the top. For example, in the field, if a user needs a 1" diameter shape charge liner, the user can only use the cone 12.

In FIG. 3, the first circular ring 14 includes a height 30, a top diameter 32, and a bottom diameter 34. Also, the first circular ring 14 includes a hollow portion 36. The top diameter 32 is less than the bottom diameter 34. The first circular ring 14 includes a top portion 38 (with the top diameter 32) and a bottom portion 40 (with the bottom diameter 34), and the hollow portion 36 is open between the top portion 38 and the bottom portion 40. The first circular ring 14 is configured to interconnect with the cone 12. For example, the bottom portion 26 of the cone 12 may interconnect with the top portion 38, of the first circular ring 14. Any interconnection mechanism is contemplated, such as, a twist-lock, tongue and groove, etc. Specifically, the diameter 22 of the cone 12 is about the same as the top diameter 32 of the first circular ring 14. In an exemplary embodiment, the top diameter 32 is about 1" and the bottom diameter 34 is about 2" although other values are contemplated. For example, in the field, if a user needs a 2" diameter shape charge liner, the user may connect the first circular ring 14 to the cone 12. Also, the first circular ring 14 may be the same or a different material from the cone 12.

In FIG. 4, the second circular ring 16 includes a height 42, a top diameter 44, and a bottom diameter 46. Also, the second circular ring 16 includes a hollow portion 48. The top diameter 44 is less (smaller) than the bottom diameter 46. The second circular ring 16 includes a top portion 50 (with the top diameter 44) and a bottom portion 52 (with the bottom diameter 46), and the hollow portion 48 is open between the top portion 50 and the bottom portion 52. The second circular ring 16 is configured to interconnect with the first circular ring 14. For example, the bottom portion 40 of the first circular ring 14 may interconnect with the top portion 50 of the second circular ring 16. Any interconnection mechanism is contemplated, such as, a twist-lock, tongue and groove, etc. Specifically, the top diameter 44 of the second circular ring 16 is about the same as the bottom diameter 34 of the first circular ring 14. In an exemplary embodiment, the top diameter 44 is about 2" and the bottom diameter 46 is about 3" although other values are contemplated. For example, in the field, if a user needs a 3" diameter shape charge liner, the user may connect the first circular ring 14 to the cone 12, and connect the second circular ring 16 to the first circular ring 14. Also, the second circular ring 16 may be the same or a different material from the cone 12 and/or the first circular ring 14.

In FIG. 5, the third circular ring 18 includes a height 60, a top diameter 62, and a bottom diameter 64. Also, the third circular ring 18 includes a hollow portion 66. The top diameter 62 is less (smaller) than the bottom diameter 64. The third circular ring 18 includes a top portion 68 (with the top diameter 62) and a bottom portion 70 (with the bottom diameter 64), and the hollow portion 66 is open between the top portion 68 and the bottom portion 70. The third circular ring 18 is configured to interconnect with the second circular ring 16. For example, the bottom portion 52 of the second circular ring 16 may interconnect with the top portion 68 of the third circular ring 18. Any interconnection mechanism is contemplated such as twist-lock, tongue and groove, etc. Specifically, the top diameter 62 of the third circular ring 18 is about the same as the bottom diameter 46 of the second circular ring. In an exemplary embodiment, the top diameter 62 is about 3" and the bottom diameter 64 is about 4" although other values are contemplated. For example, in the field, if a user needs a 4" diameter shape charge liner, the user may connect the first circular ring 14 to the cone 12, connect the second circular ring 16 to the first circular ring 14, and connect the third circular ring 18 to the second circular ring 16. Also, the third circular ring 18 may be the same or a different material from the cone 12, the first circular ring 14, and/or the second circular ring 16.

Note, each of the cone 12 and the rings 14, 16, 18 are angled, which forms the overall angle of the UCSCL 10. The diameter of the UCSCL 10 is configurable based on how many of the rings 14, 16, 18 are used. In the exemplary embodiments, the UCSCL 10 may have a diameter of about 1", 2", 3", or 4" although other values are contemplated with more rings or differing sized rings. The UCSCL 10 may also have different angles as required. The overall UCSCL 10 may be different angles or the user may configure different angles in the cone by using different rings, i.e. you could start with one angle and finish with another (it would be like a trumpet).

Two exemplary aspects of the UCSCL 10 include improved manufacturing through lower cost, easier manufacturing, and less waste and improve carrying ability. With respect to the manufacturing, the rings 14, 16, 18 may be cut out of pipe or the like. The UCSCL 10 does not have to be machined as one piece, but as the separate, field configurable parts. The back half of the liner may be inverted into the front half thereby creating a conical liner that produces linear cuts in a circular pattern.

Figure 6:
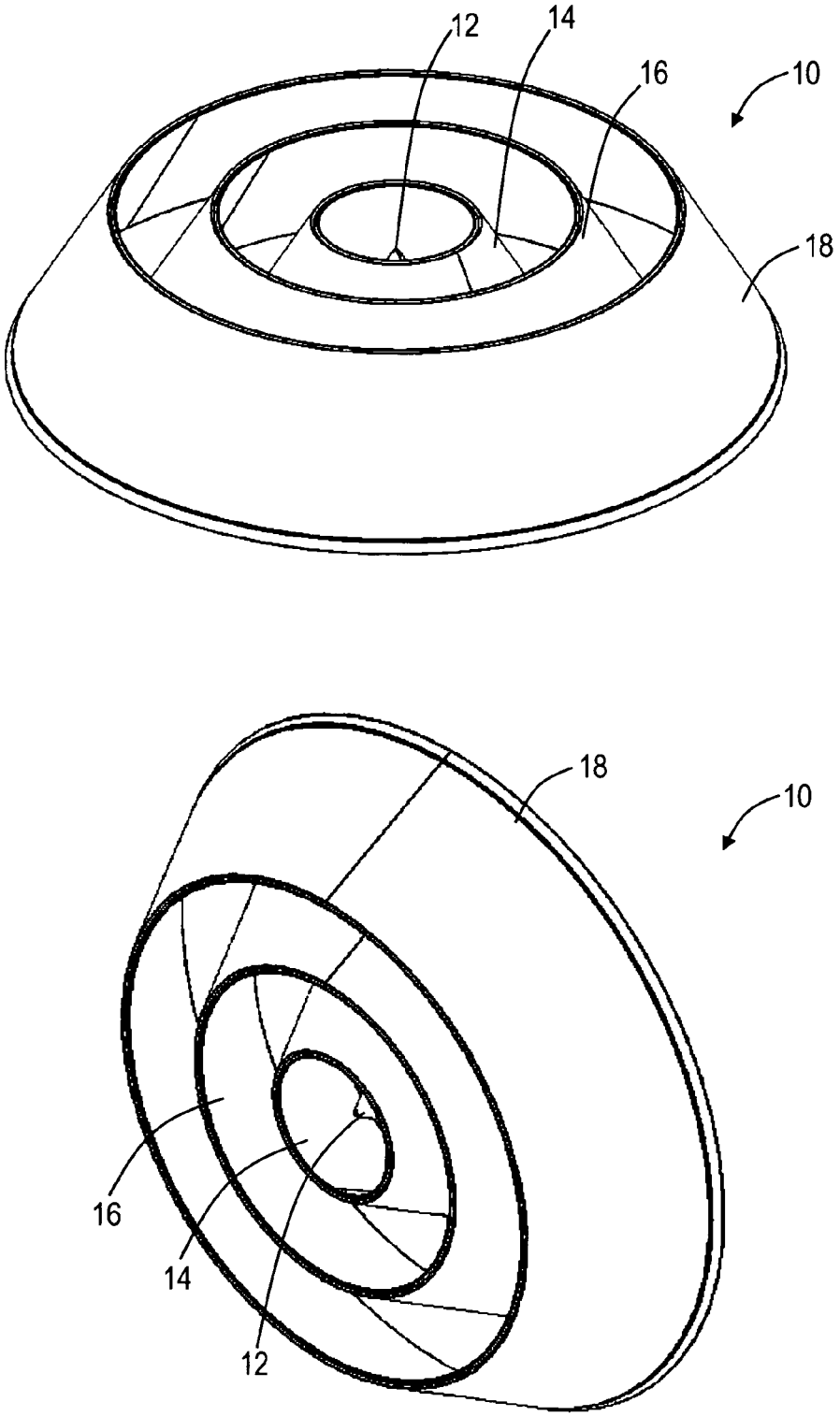
FIG. 6 is perspective diagrams of the UCSCL of FIG. 1 in a stacked configuration in accordance with an exemplary embodiment.
Figure 7:
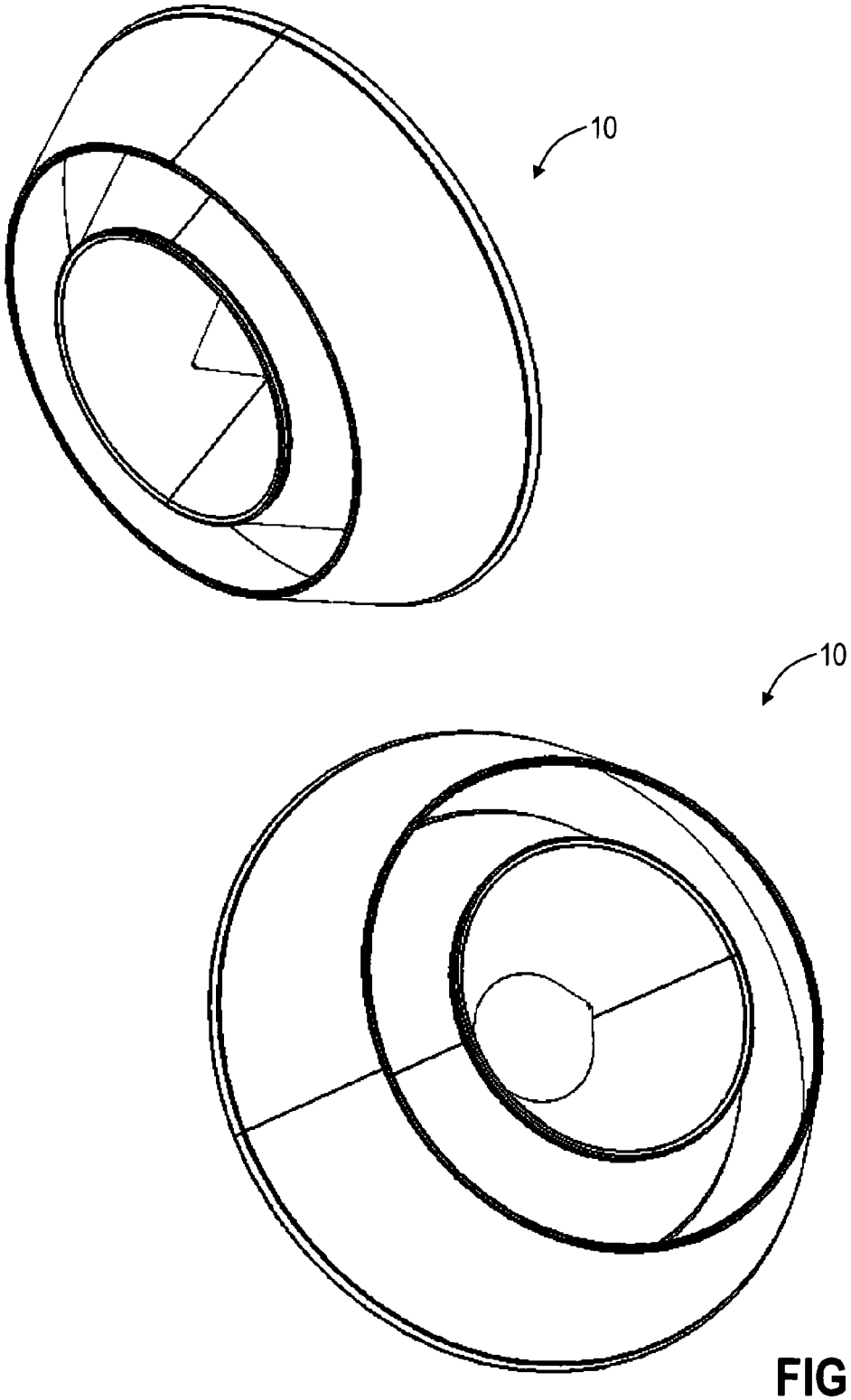
FIG. 7 is perspective diagrams of the UCSCL of FIG. 1 in a reversed stacked configuration in accordance with an exemplary embodiment.

With respect to carrying ability, referring to FIGS. 6 and 7, in exemplary embodiments, perspective views illustrate the UCSCL 10 in a stored state. FIG. 6 illustrates the UCSCL 10 in a stacked configuration where the second circular ring 16 is placed within the hollow section 66 of the third circular ring 18, the first circular ring 14 is placed within the hollow section 48 of the second circular ring 16, and the cone 12 is placed within the hollow section 36 of the first circular ring 14. Note, the overall carrying size of the UCSCL 10 is no bigger than the largest of the heights and the diameter 64. This configuration is a significant improvement over a full cone shape, and much easier for EOD personnel to carry in backpacks.

FIG. 7 illustrates a reversed stacked configuration where the third circular ring 18 and the second circular ring 16 are carried as shown in FIG. 6, the first circular ring 14 is inverted in the hollow section 48 of the second circular ring 16, and the cone 12 is placed in the hollow section 36 of the first circular ring 14. Thus, as shown in FIGS. 6 and 7, the UCSCL 10 may be nested together to save space when carried, stored, or shipped.

Another advantage of the UCSCL 10 is that the different parts may be composed of different materials interchangeably for different charge diameters and effects. Liners have been made from many materials, including various metals and glass. In an exemplary embodiment, the deepest penetrations are achieved with a dense, ductile metal, and a very common choice has been copper. In other exemplary embodiments, for some modern anti-armor weapons, molybdenum and pseudo-alloys of tungsten filler and copper binder (9:1, thus density is ~18 Mg/m3) have been adopted. The cone 12 and the ring sections 14, 16, 18 may be any common metallic element, including aluminum, tungsten, tantalum, depleted uranium, lead, tin, cadmium, cobalt, magnesium, titanium, zinc, zirconium, molybdenum, beryllium, nickel, silver, and even gold and platinum. The selection of the material depends on the target to be penetrated; for example, aluminum has been found advantageous for concrete targets. Copper is used as a liner material for antitank, and tantalum is superior to copper, due to its much higher density and very high ductility at high strain rates. Other high-density metals and alloys tend to have drawbacks in terms of price, toxicity, radioactivity, or lack of ductility.

For the deepest penetrations, pure metals generally yield the best results, because they display the greatest ductility, which delays the breakup of the jet into particles as it stretches. In charges for oil well completion, however, it is essential that a solid slug or "carrot" not be formed as it would plug the hole just penetrated and interfere with the influx of oil. In the petroleum industry, therefore, liners are generally fabricated by powder metallurgy, often of pseudo-alloys which, if unsintered, yield jets that are composed mainly of dispersed fine metal particles.

Unsintered cold pressed liners, however, are not waterproof and tend to be brittle, which makes them easy to damage during handling—which is an advantage here due to the compact carrying size—this can overcome the potential damage. Bimetallic liners, usually zinc-lined copper, may be used. During jet formation, the zinc layer vaporizes and a slug is not formed. The disadvantage is an increased cost and dependency of jet formation on the quality of bonding the two layers. Low-melting-point (below 500° C.) solder/braze-like alloys (e.g., Sn50Pb50, Zn97.6Pb1.6, or pure metals like lead, zinc or cadmium) may be used. These materials melt before reaching the well casing, and the molten metal does not obstruct the hole. Other alloys, binary eutectics (e.g. Pb88.8Sb11.1, Sn61.9Pd38.1, or Ag71.9Cu28.1), form a metal-matrix composite material with ductile matrix with brittle dendrites; such materials reduce slug formation but are difficult to shape.

A metal-matrix composite with discrete inclusions of low-melting material is another option. The inclusions either melt before the jet reaches the well casing, weakening the material, or serve as crack nucleation sites, and the slug breaks up on impact. The dispersion of the second phase may be achieved also with castable alloys (e.g., copper) with a low-melting-point metal insoluble in copper, such as bismuth, 1-5% lithium, or up to 50% (usually 15-30%) lead; the size of inclusions can be adjusted by thermal treatment. Non-homogeneous distribution of the inclusions may also be achieved. Other additives may modify the alloy properties; tin (4-8%), nickel (up to 30% and often together with tin), up to 8% aluminum, phosphorus (forming brittle phosphides) or 1-5% silicon form brittle inclusions serving as crack initiation sites. Up to 30% zinc may be added to lower the material cost and to form additional brittle phases.

Oxide glass liners produce jets of low density, therefore yielding less penetration depth. Double-layer liners, with one layer of a less dense but pyrophoric metal (e.g. aluminum or magnesium), may be used to enhance incendiary effects following the armor-piercing action. Explosive welding may be used for making those, as then the metal-metal interface is homogeneous, does not contain significant amount of intermetallics, and does not have adverse effects to the formation of the jet.

The penetration depth is proportional to the maximum length of the jet, which is a product of the jet tip velocity and time to particulation. The jet tip velocity depends on bulk sound velocity in the liner material, the time to particulation is dependent on the ductility of the material. The maximum achievable jet velocity is roughly 2.34 times the sound velocity in the material. The speed can reach 10 km/s, peaking some 40 microseconds after detonation; the cone tip is subjected to acceleration of about 25 million g. The jet tail reaches about 2-5 km/s. The pressure between the jet tip and the target may reach one terapascal. The immense pressure makes the metal flow like a liquid, though x-ray diffraction has shown the metal stays solid; one of the theories explaining this behavior proposes molten core and solid sheath of the jet. The best materials are face-centered cubic metals, as they are the most ductile, but even graphite and zero-ductility ceramic cones show significant penetration.

Figure 8:
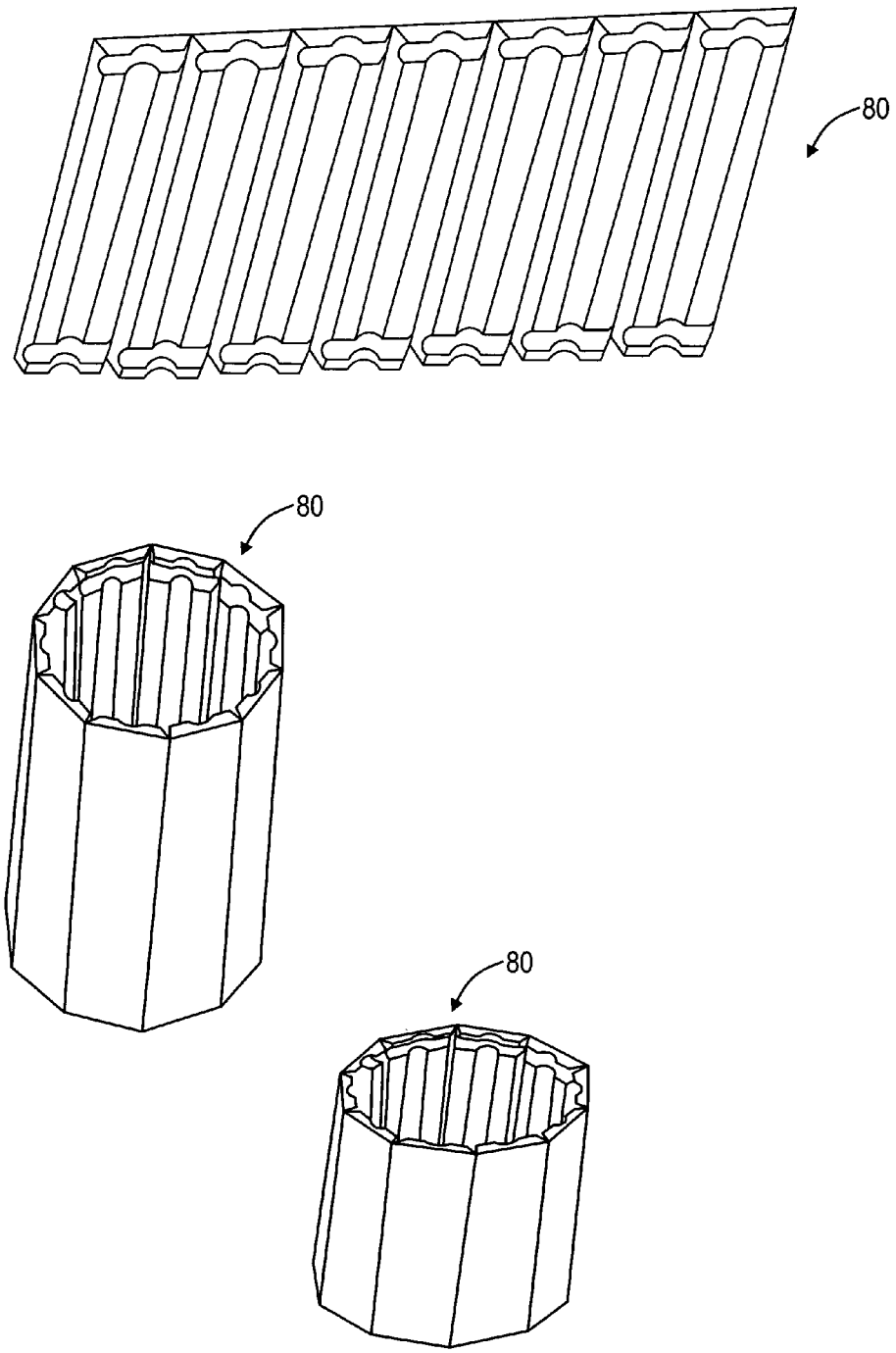
FIG. 8 is perspective diagrams of a User Configurable Charge System (UCCS) for use with the UCSCL of FIG. 1 in accordance with an exemplary embodiment.

Referring to FIG. 8, in an exemplary embodiment, perspective views illustrate a container or housing for a User Configurable Charge System (UCCS) 80. The UCCS 80 is a flexible housing material in a roll or sheet of user indexable material. The user tears off a specific needed amount of a specific diameter or configuration for use as the container for a field packable shape charge capable of creating various diameters, i.e. the UCSCL 10. The applicable UCSCL 10 is chosen and inserted into the plastic user indexable housing, the UCCS 80. The appropriate length (corresponding to the required diameter) of the flexible UCCS 80 housing is then filled with explosives, generally C-4 in order to make the UCCS shape charge module, which may be made longer by snapping them together. A rigid ring, which may either be used to gang or connect several UCCS modules together (including empty housings for use as stand-off or mounting fixtures) or as the interface for a back plate, is used to attach the method of ignition, detonation, or detonator, and is snapped onto the back of the charge. This ring provides for rigidity and as an interface for mounting of sighting devices or the UCCS itself. The UCCS 80 is also easy to carry as it may be rolled up or flat.

Figure 9:
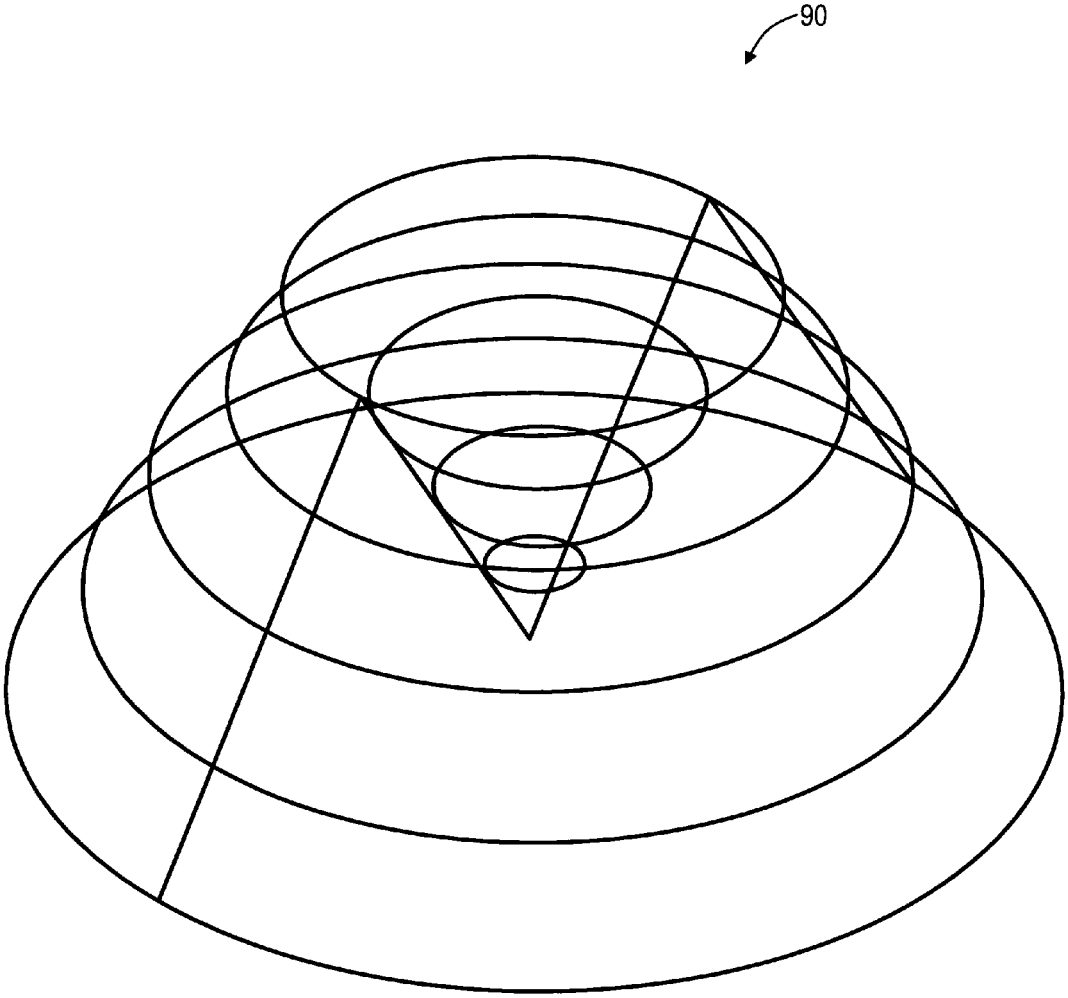
FIG. 9 is a perspective of illustrates another configuration 90 of the UCSCL of FIG. 1 in accordance with an exemplary embodiment.

Referring to FIG. 9, in an exemplary embodiment, a perspective view illustrates another configuration 90 of the UCSCL 10. Specifically, as the UCSCL 10 is modular and user-configurable, the configuration 90 may be created where the cone 12, and one or more of the circular rings 14, 16, 18 are inverted into the front half. This configuration is an entirely different way to use a conical shape charge as it is the exact same liner components. However, since it is modular, you may invert the back 50% and create a circle cut with a conical shape charge instead of the typical pin hole. In particular, the configuration 90 is a way to employ it in order to achieve the effect of cutting a larger diameter circular cut instead of a single hole.

Although the present disclosure has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A configurable shape charge liner, comprising:

a cone, wherein the cone is hollow and comprises a cone bottom portion, and wherein the cone bottom portion comprises a cone bottom diameter; and at least one circular ring section, wherein each of said at least one circular ring section is hollow and comprises a circular ring section top diameter and a circular ring section bottom diameter, wherein the circular ring section top diameter is less than the circular ring section bottom diameter, wherein the cone and said at least one circular ring section is connectable therebetween to form different overall diameters for the configurable shape charge liner, and wherein the configurable shape charge liner comprises a conical shape.

2. The configurable shape charge liner of claim 1, wherein the cone comprises a first material, and wherein said at least one circular ring section comprises a second material.

3. The configurable shape charge liner of claim 2, wherein the first material and the second material are comprised of any of copper, magnesium, zirconium and glass/metal alloys.

4. The configurable shape charge liner of claim 2, wherein the first material is a different material than the second material.

5. The configurable shape charge liner of claim 1, wherein said at least one circular ring section comprises a first circular ring section, wherein the first circular ring section comprises a first top portion with a first top ring diameter and a first bottom portion with a first bottom ring diameter, wherein the first top ring diameter is less than the first bottom ring diameter, wherein the first top ring diameter is about equal to the cone bottom diameter, and wherein the cone bottom portion is selectively connectable to the first top portion.

6. The configurable shape charge liner of claim 5, wherein said at least one circular ring section further comprises a second circular ring section, wherein the second circular ring section comprises a second top portion with a second top ring diameter and a second bottom portion with a second bottom ring diameter, wherein the second top ring diameter is less than the second bottom ring diameter, wherein the second top ring diameter is about equal to the first bottom ring diameter, and wherein the first bottom portion is selectively connectable to the second top portion.

7. The configurable shape charge liner of claim 5, wherein said at least one circular ring section further comprises a second circular ring section, wherein the second circular ring section comprises a second top portion with a second top ring diameter and a second bottom portion with a second bottom ring diameter, wherein said at least one circular ring section further comprises a third circular ring section, wherein the third circular ring section comprises a third top portion with a third top ring diameter and a third bottom portion with a third bottom ring diameter, wherein the third top ring diameter is less than the third bottom ring diameter, wherein the third top ring diameter is about equal to the second bottom ring diameter, and wherein the second bottom portion is selectively connectable to the third top portion.

8. The configurable shape charge liner of claim 5, wherein said at least one circular ring section comprises a second circular ring section and a third circular ring section, wherein the second circular ring section is storable in the third circular ring section, wherein the first circular ring section is storable in the second circular ring section, and wherein the cone is storable in the first circular ring section.

9. A configurable shape charge system, comprising:

a cone, wherein the cone is hollow and comprises a cone bottom portion, and wherein the cone bottom portion comprises a cone bottom diameter;

at least one circular ring section, wherein each of said at least one circular ring section is hollow and comprises a circular ring section top diameter and a circular ring section bottom diameter, wherein the circular ring section top diameter is less than the circular ring section bottom diameter; and a flexible, tubular housing;

wherein the cone and said at least one circular ring section is connectable therebetween to form different overall diameters for the configurable shape charge liner, and wherein the configurable shape charge liner comprises a conical shape.

10. The configurable shape charge system of claim 9, wherein the cone comprises a first material, and wherein said at least one circular ring section comprises a second material.

11. The configurable shape charge system of claim 10, wherein the first material and the second material are comprised of any of copper, magnesium, zirconium and glass/metal alloys.

12. The configurable shape charge system of claim 10, wherein the first material is a different material than the second material.

13. The configurable shape charge system of claim 9, wherein said at least one circular ring section comprises a first circular ring section, wherein the first circular ring section comprises a first top portion with a first top ring diameter and a first bottom portion with a first bottom ring diameter, wherein the first top ring diameter is less than the first bottom ring diameter, wherein the first top ring diameter is about equal to the cone bottom diameter, and wherein the cone bottom portion is selectively connectable to the first top portion.

14. The configurable shape charge system of claim 13, wherein said at least one circular ring section further comprises a second circular ring section, wherein the second circular ring section comprises a second top portion with a second top ring diameter and a second bottom portion with a second bottom ring diameter, wherein the second top ring diameter is less than the second bottom ring diameter, wherein the second top ring diameter is about equal to the first bottom ring diameter, and wherein the first bottom portion is selectively connectable to the second top portion.

15. The configurable shape charge system of claim 13, wherein said at least one circular ring section further comprises a second circular ring section, wherein the second circular ring section comprises a second top portion with a second top ring diameter and a second bottom portion with a second bottom ring diameter, wherein said at least one circular ring section further comprises a third circular ring section, wherein the third circular ring section comprises a third top portion with a third top ring diameter and a third bottom portion with a third bottom ring diameter, wherein the third top ring diameter is less than the third bottom ring diameter, and wherein the third top ring diameter is about equal to the second bottom ring diameter, and the second bottom portion is selectively connectable to the third top portion.

16. The configurable shape charge system of claim 13, wherein said at least one circular ring section comprises a second circular ring section and a third circular ring section, wherein the second circular ring section is storable in the third circular ring section, wherein the first circular ring section is storable in the second circular ring section, and wherein the cone is storable in the first circular ring section.

17. A method, comprising:

obtaining a configurable shape charge liner, wherein the configurable shape charge liner comprises a cone and at least one circular ring section, wherein the cone is hollow and comprises a cone bottom portion, wherein the cone bottom portion comprises a cone bottom diameter, wherein each of said at least one circular ring section is hollow and comprises a circular ring section top diameter and a circular ring section bottom diameter, wherein the circular ring section top diameter is less than the circular ring section bottom diameter, wherein the cone and said at least one ring section are connectable therebetween to form different overall diameters for the configurable shape charge liner, and wherein the configurable shape charge liner comprises a conical shape; and selectively connecting the cone and said at least one circular ring section based on a desired diameter.

* * * * *